US006060152A

United States Patent [19]

Murchie

[11] Patent Number: 6,060,152

[45] Date of Patent: May 9, 2000

[54] FABRIC WITH MICROENCAPSULATED BREACH INDICATION COATING

[76] Inventor: Colin C. Murchie, 249 Knight Rd., Vestal, N.Y. 13850

[21] Appl. No.: 09/138,269

[22] Filed: Aug. 21, 1998

[51] Int. Cl.[7] ..... B32B 3/26

[52] U.S. Cl. ..... 428/313.5; 428/321.5; 427/458; 427/389.9

[58] Field of Search ..... 428/313.5, 321.5; 427/458, 389.9

[56] References Cited

U.S. PATENT DOCUMENTS

| | | | |
|---|---|---|---|
| 3,935,960 | 2/1976 | Cornell | 220/260 |
| 4,424,911 | 1/1984 | Resnick | 215/365 |
| 5,304,684 | 4/1994 | Nishida et al. | 568/385 |

*Primary Examiner*—Christopher Raimund
*Attorney, Agent, or Firm*—Salzman & Levy

[57] ABSTRACT

A membrane coated with or incorporating a number of different types of microcapsules is disclosed. A first and second type of microcapsule each contain one component of a chemical reaction that produces a chemical agent that is capable of dissolving the shells of all microcapsules, while a third type of microcapsule has a dye or other indicator encapsulated by a chemically dissolvable shell. A structural violation of the membrane also violates the capsules, causing not only the release of an indicator or pharmacologically active substance from the capsules but also the initiation of chemical chain reaction that broadens the scope of the reaction that broadens the scope of the indication beyond the site of the initial breach in the membrane.

17 Claims, 3 Drawing Sheets

FABRIC WITH MICROENCAPSULATED BREACH INDICATION COATING

FIELD OF INVENTION

This invention relates to coated fabrics, specifically to fabrics that provide a visible indication of rupture or breaching.

BACKGROUND

Workers who deal with pathogenic or dangerous materials must often be completely isolated from their external environment. The same restriction applies to many other situations, as with recently sterilized medical equipment. The usual method of ensuring isolation is via an impermeable plastic membrane. These membranes, however, are vulnerable to punctures or tears that compromise their utility. In many cases, these punctures occur without the knowledge of the user, who continues to use the enclosure, assuming that it is intact.

Previous attempts to provide a visual indication of the rupture of a plastic membrane include U.S. Pat. No. 4,986,429 issued to Singleton (1991), which discloses a material for wrapping the necks of pharmaceutical bottles which consists of a series of longitudinally arranged, pressurized sacs of dye arranged around the neck of the bottle, which dispense their dye upon being ruptured. There are a number of disadvantages to this design, however. The membrane is expensive and difficult to make. Once made, it has a great weight. It also has limited mobility-creasing or folding the material is likely to rupture one or more of the sacs. The sacs are sensitive to temperature and pressure. Moreover, it is also a destructive notification. Once the material has been ruptured in one location, the entire apparatus must be discarded. Forming complex shapes (such as a suit or glove) would also be difficult and expensive using this material.

U.S. Pat. No. 4,930,522 issued to Busnel, et al. (1990) describes a prophylactic device consisting of inner and outer barrier membranes separated by a layer of a pharmacologically active substance. The assumption is that any rupture of the membrane will release the substance, thereby mitigating the effects of the rupture. Presumably, dye could replace the substance, providing a visible indication of a tear. There are a number of disadvantages to this approach, as well. First, the use of a single liquid containing membrane raises the possibility that the indicator fluid will pool in lower-lying areas of the membrane, negating the efficacy of upper areas. It also means that any devices formed from this fabric would have to consist of one seamless piece, as seams would be both be devoid of protection and vulnerable to leaks. Even assuming a uniform distribution of fluid, many small punctures, as those caused by a hypodermic needle, would be unlikely to be detectable. Finally, the dual membrane would be extremely inflexible.

U.S. Pat. No. 5,104,704 issued to Labes et al. (1992) uses a slightly different system, reacting dye precursor gels to produce the desired color change. This method is bulky, heavy, and expensive, and is limited to small-scale uses, such as pill bottle caps.

U.S. Pat. No. 4,424,911 issued to Resnick (1984) uses microspheres containing a substance which, when released by mechanical trauma, causes a permanent color change in the substrate paper. It is exactly this permanent change that is problematical with this method. Along with many of the aforementioned devices, its indication is irreversible. In addition, the substrate paper, especially if it is litmus as described in one embodiment, is vulnerable to "false positives" due to environmental factors.

U.S. Pat. No. 3,935,960 issued to Cornell (1976) describes a tape cover for older soda cans which comprises two dye precursors, which, upon mechanical trauma, are mixed. This device is relatively inflexible. The color change occurs at very low angles of flexion. As with many of the above devices, the tape cover indicates that a trauma or violation has occurred only in the area immediately adjoining the site of the trauma.

U.S. Pat. No. 5,304,684 to Nishida et al. describes a process for producing methyl ethyl ketone by decomposing sec-butylbenzene in the presence of an acid catalyst.

Accordingly, besides the objects and advantages of the devices listed above, several objects and advantages of the present invention are:

- To provide a membrane or garment that is light, flexible, and easily manufactured, even in complex shapes;
- To provide a membrane that offers equal protection in all temperature and pressure environments, even at seams, joins, and folds;
- To provide a membrane that is activated by any breach or puncture, no matter what the size;
- To provide a membrane that is reparable after puncture, and that retains its indicating qualities; and
- To provide a membrane that creates an indication large in size and readily apparent, even for small punctures.

Further objects and advantages will become apparent from a consideration of the following description and drawings.

SUMMARY

In accordance with the present invention, there is provided a membrane or fabric or garment coated with or incorporating a number of different types of microcapsules. A first type of microcapsule contains an indicator or pharmacologically active substance encapsulated by a chemically dissolvable shell. The second type of microcapsule contains one component of a chemical lytic agent, and the third type of microcapsule contains another component of the aforementioned lytic agent. Additional components may be incorporated if the lytic agent is more chemically complex. A structural violation of the membrane also violates the capsules, causing not only the release of an indicator or pharmacologically active substance from the capsules, but also the initiation of a chemical chain reaction which broadens the scope of the indication beyond the site of the initial breach in the membrane.

BRIEF DESCRIPTION OF THE DRAWINGS

A complete understanding of the present invention may be obtained by reference to the accompanying drawings, when taken in conjunction with the detailed description there of and in which.

DETAILED DESCRIPTION OF THE PREFERRED EMBODIMENT

In accordance with the present invention, there is provided a membrane coated with or incorporating a number of different types of microcapsules. A first type of microcapsule contains an indicator or pharmacologically active substance encapsulated by a chemically dissolvable shell. The second type of microcapsule contains one component of a chemical lytic agent, and the third type of microcapsule contains another component of the aforementioned lytic agent. Additional microcapsules containing additional components may be incorporated if the lytic agent is more chemically complex. A structural violation of the membrane also violates the capsules, causing not only the release of an indicator or pharmacologically active substance from the capsules, but also the initiation of a chemical chain reaction which broadens the scope of the indication beyond the site of the initial breach in the membrane.

Figure 1:
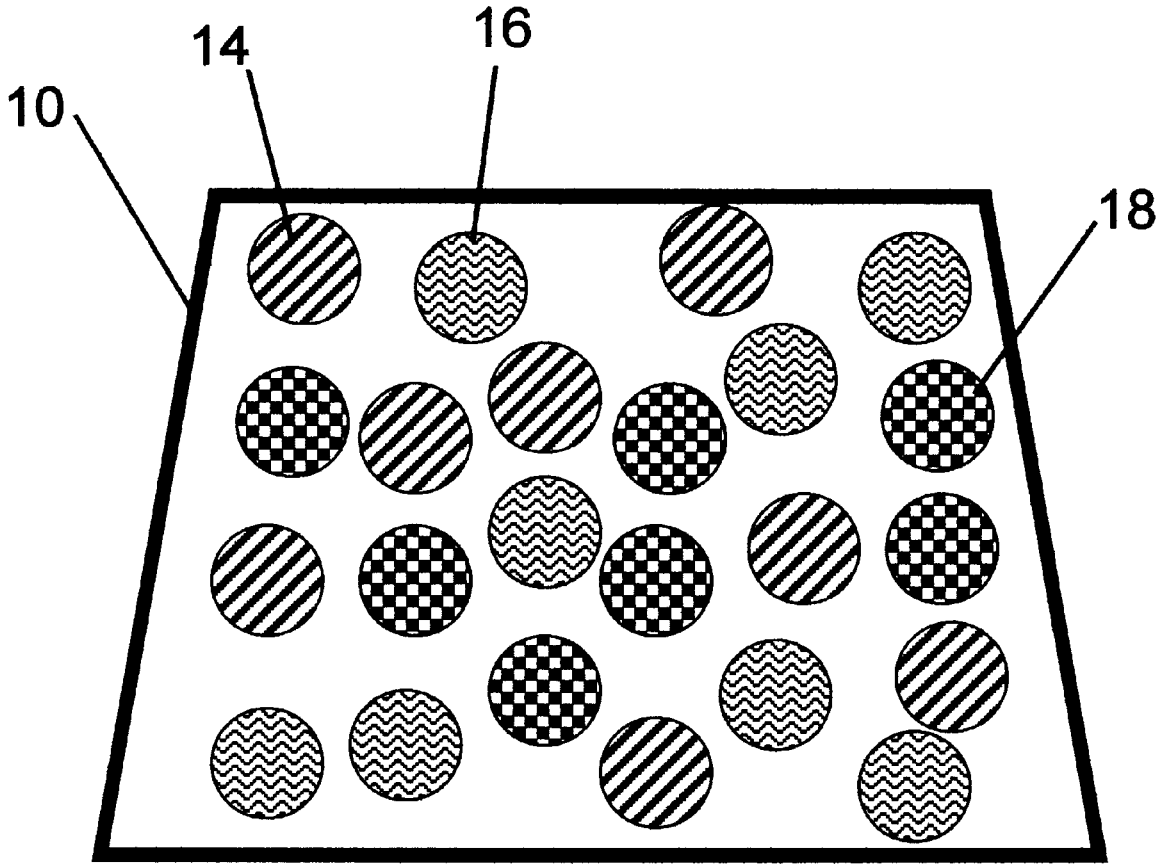
FIG. 1 is a perspective view of fabric in which is disposed a membrane having a plurality of microcapsules.
Figure 2:
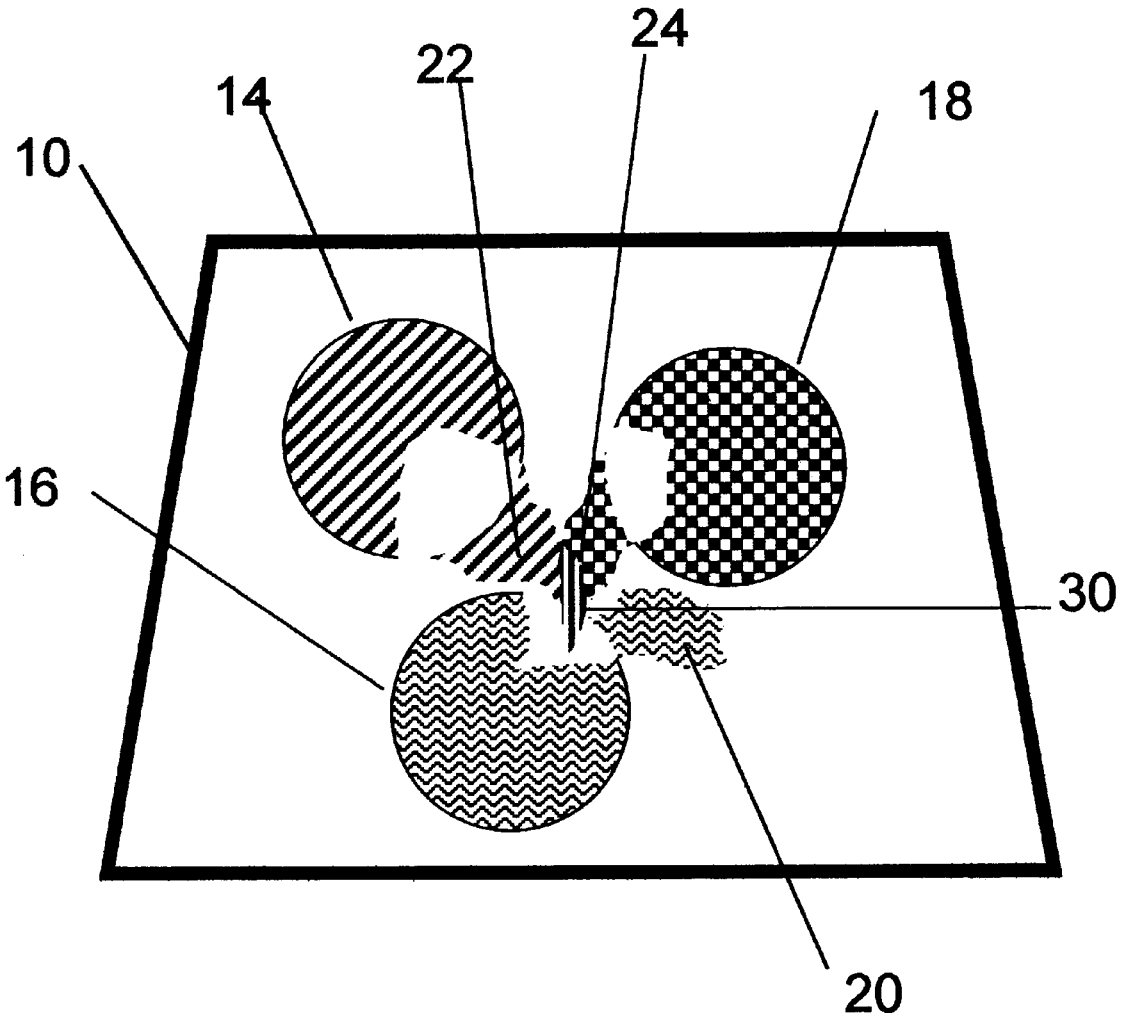
FIG. 2 is an enlarged view of a section of the membrane shown in FIG. 1.

Referring now to FIGS. 1 and 2, there is shown a perspective and enlarged perspective view, respectively, of a membrane 10 in or on which a plurality of microcapsules 14, 16 and 18 are randomly distributed. Of course, it should be understood that the microcapsules 14, 16 and 18 can be dispersed on or in the membrane 10 in a predetermined pattern, if desired. For simplicity, one type of indicator capsule 14 and two types of activator capsule 16 and 18 are shown and described in greater detail hereinbelow, but it should be understood that other combinations and configurations may be used without departing from the scope of the invention. Each microcapsule 14, 16 and 18 comprises a chemical filling encapsulated by a soluble shell, described in greater detail hereinbelow.

The membrane 10 consists of the material currently used for the relevant enclosure or purpose. In the case of biohazard-isolation suits, such material may be Tyvek® or Tychem® material produced by Lakeland Industries in Ronkonkoma, N.Y. As aforementioned, a number of different microcapsules 14, 16 and 18 are attached by adhesives, or other suitable means well known in the art, to the membrane 10.

Microcapsules 14 are indicator capsules, containing either a pharmacologically active substance, a dye which contrasts with the color of the membrane 10, or some other indicator substance 20. Microcapsules 16 and 18 are activator capsules. Each contains one reactant in a chemical reaction which produces a lytic agent capable of dissolving the containers of neighboring microcapsules 14, 16 and 18. For example, if the shells of the capsules 14, 16 and 18 are composed of ethyl cellulose, the desired lytic agent could be methyl ethyl ketone. Capsule 16 could then contain sec-butylbenzene hydroperoxide, and capsule 18 could contain an acid catalyst, to achieve the desired reaction. Other reactions may be used, requiring more than two varieties of activator capsules to achieve the required reaction.

Whenever the membrane 10 is violated (i.e., ripped, torn, ruptured, scorched, dissolved, etc.), many of the microscopic microcapsules 14, 16 and 18 will be violated as well. The rupture of effector capsules 14 causes the release of their encapsulated effector substance 20. The rupture of activator capsules 16 and 18 likewise causes the release of their respective encapsulated reactant components 22 and 24. These components in isolation are not reactive with respect to capsule shells or walls. It is Only when their respective container capsules 16 and 18 are structurally violated and the two components 22 and 24 are allowed to mix that they form a lytic agent 30 capable of violating neighboring capsules 14, 16 and 18 chemically. This begins a chain reaction that increases the area of membrane 10 over which the release of effector substance 20 takes place. For instance, if the only indicator component is a dye, the user perceives a spreading stain around the area of the puncture. Of course, additional indicators or other substances, such as disinfectants, may be added to the indicator capsules relatively simply and inexpensively.

Figure 3:
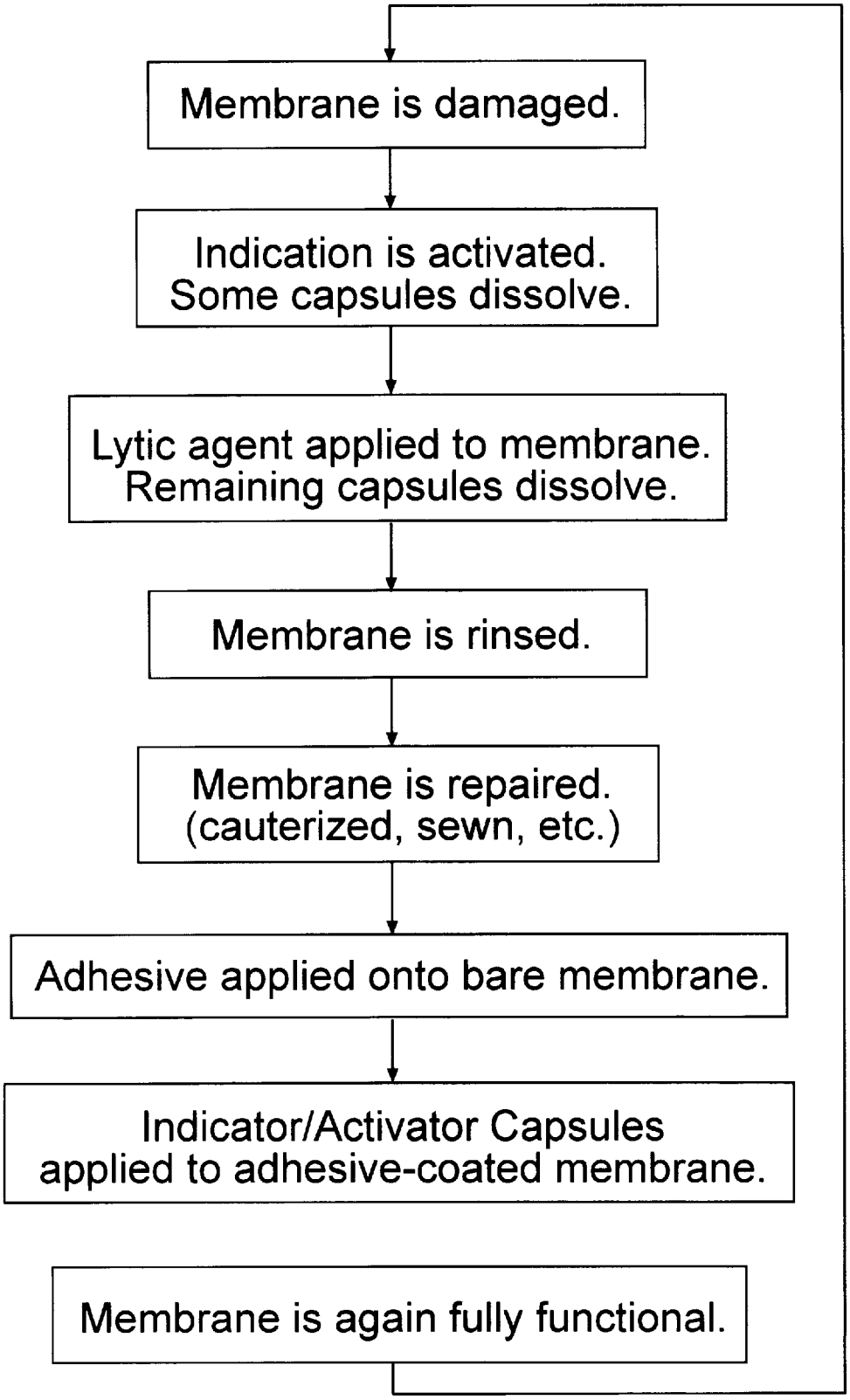
FIG. 3 is a flow chart of the process for replacing a portion of fabric in accordance with the present invention.

Referring now to FIG. 3, the indicator and effector components are easily removed and replaced as follows. Prior to the repair of the substrate fabric itself, the entire surface thereof can be exposed to the aforementioned lytic agent, which would dissolve both the activator 16 and 18 and effector 14 capsules. New capsules 14, 16 and 18 may then be applied, simply by being sprayed on at low pressure, associated with an adhesive, or by some other suitable method.

From the foregoing description, it can be seen that the membrane described can be manufactured relatively cheaply, and in an unlimited variety of shapes and sizes, as the effector coating is added after the membrane component is made. It can also be seen that the indication involves a relatively large area of the membrane, even for small ruptures, and is unlikely to activate for stimuli other than a genuine violation. The effector substance's action is activated for even tiny punctures, as only two of the microscopic capsules need be ruptured to initiate the reaction.

Although the foregoing description includes preferred applications and embodiments, these should not be construed as limiting the scope of the invention, but merely as illustrative examples, used to point out the limitations of existing technology. The material described could be used in any situation in which the integrity of a flexible membrane is of concern.

Thus the scope of the invention should be determined by the appended claims and their legal equivalents, rather than by the examples given

I claim:

1. A membrane having means for indicating rupture or breach thereof, the membrane comprising:

a) a plurality of first microcapsules each having a shell and encapsulating a first effector component;

b) a plurality of second microcapsules each having a shell and encapsulating a second effector component which is capable of reacting with said first effector component to form a lytic agent; and c) a plurality of third microcapsules each having a shell and encapsulating an indicator substance;

whereby, when said membrane is ruptured, at least one of said plurality of first microcapsules is caused to release said first effector component, and at least one of said plurality of second microcapsules is caused to release said second effector component to form a lytic agent to dissolve the shell of at least one of said plurality of first microcapsules and of said plurality of second microcapsules, and of said plurality of third microcapsules.

2. The membrane of claim 1, wherein said lytic agent comprises methyl ethyl ketone.

3. The membrane of claim 1, wherein said first effector component comprises sec-butylbenzene hydroperoxide.

4. The membrane of claim 1, wherein said second effector component comprises an acid catalyst.

5. The membrane of claim 1, wherein said indicator substance is visually perceptible upon release from said third encapsulating microcapsule.

6. The membrane of claim 5, wherein said indicator comprises a dye.

7. The membrane of claim 1, wherein said indicator substance produces a perceptible scent upon release from said third encapsulating microcapsule.

8. The membrane of claim 1, wherein said indicator substance alters the electrical properties of said membrane upon release from said third encapsulating microcapsule.

9. The membrane of claim 1, wherein said indicator substance alters the texture of said membrane upon release from said encapsulating microcapsule.

10. The membrane of claim 1, wherein the shells of said microcapsules comprise ethyl cellulose.

11. The membrane of claim 1, further comprising a plurality of fourth microcapsules each having a shell and encapsulating a second indicator substance.

12. The membrane of claim 1, wherein said microcapsules are from 0.5 to 50 microns in diameter.

13. A method for repairing a breached fabric, and for providing means for indicating subsequent breach thereof, the steps comprising:

a) repairing a fabric; and b) applying a plurality of microcapsules to said fabric, said microcapsules comprising:

i) a first set of microcapsules each having a shell and encapsulating a first effector component;

ii) a second set of microcapsules each having a shell and encapsulating a second effector component which is capable of reacting with said first effector component to form a lytic agent, and iii) a third set of microcapsules each having a shell and encapsulating an indicator substance.

14. The method for repairing a breached fabric and for providing means for indicating subsequent breach thereof, in accordance with claim 13, wherein said plurality of microcapsules is applied to said fabric by means of an adhesive.

15. The method for repairing a breached fabric and for providing means for indicating subsequent breach thereof, in accordance with claim 13, wherein said plurality of microcapsules is applied to said fabric by means of an applied static charge.

16. The method for repairing a breached fabric and for indicating subsequent breach thereof, in accordance with claim 13, wherein said lytic agent comprises methyl ethyl ketone.

17. The method for repairing a breached fabric and for indicating subsequent breach thereof, in accordance with claim 13, wherein said microcapsules are between 0.5 and 50 microns in diameter.

* * * * *